United States Patent [19]

Bennett

[11] 4,162,748

[45] Jul. 31, 1979

[54] DISPENSER USING BELLEVILLE DIAPHRAGM

[75] Inventor: Robert S. Bennett, Easton, Conn.

[73] Assignee: Risdon Manufacturing Company, Torrington, Conn.

[21] Appl. No.: 869,040

[22] Filed: Jan. 13, 1978

[51] Int. Cl.[2] ..... B65D 37/00

[52] U.S. Cl. ..... 222/632; 222/212; 239/327

[58] Field of Search ..... 222/193, 206, 207, 209, 222/212, 215; 239/327, 363

[56] References Cited

U.S. PATENT DOCUMENTS

| | | | |
|---|---|---|---|
| 2,048,698 | 7/1936 | Howell | 222/212 X |
| 2,786,717 | 3/1957 | Rausch | 239/327 |

*Primary Examiner*—Robert J. Spar
*Assistant Examiner*—Charles A. Marmor

[57] ABSTRACT

Each of first and second shallow hollow cylinders has a closed end and an open end, said cylinders being interconnected at their open ends with the first cylinder being disposed concentrically within the second cylinder. Each cylinder is rotatable through a selected arc with respect to the other cylinder between open and closed positions, the cylinders having cooperating structures which define a channel in the outer surface of the first cylinder which forms a circular arc and which lies in a plane perpendicular to the axes of the cylinders. The first cylinder has first and second oppositely disposed openings extending through the cylinder wall and lying in the plane of the channel, the second cylinder having a third opening extending through the cylinder wall which when the cylinders are in the open position is in registration both with the first opening and the channel and when the cylinders are in the closed position is out of registration with the first opening and the channel. The closed end of the second cylinder defines a belleville diaphragm.

8 Claims, 14 Drawing Figures

FIG. 2
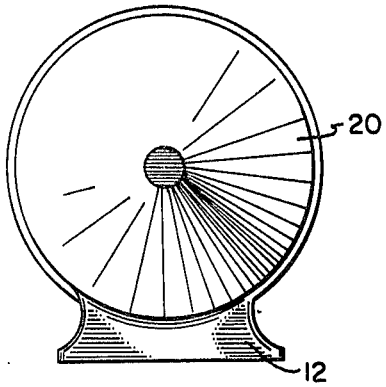
FIG. 4
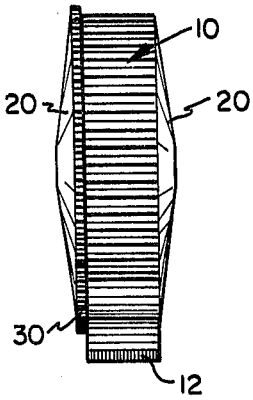
FIG. 3
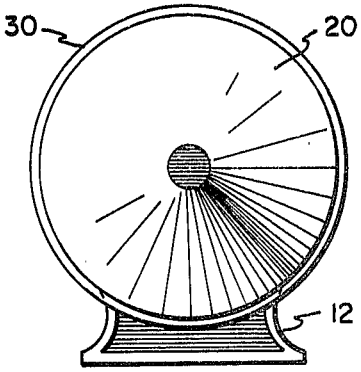
FIG. 7
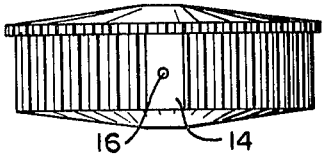
FIG. 5
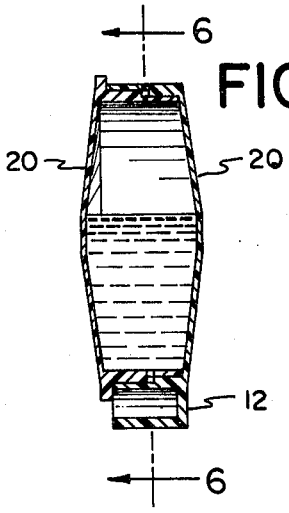
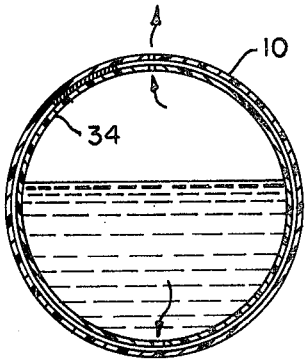
FIG. 6
FIG. 8
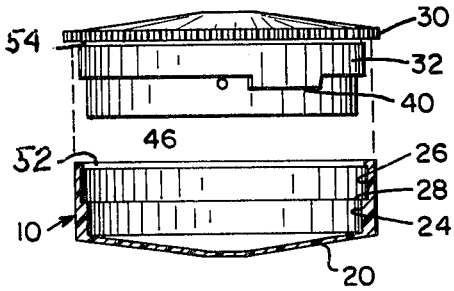
FIG. 9
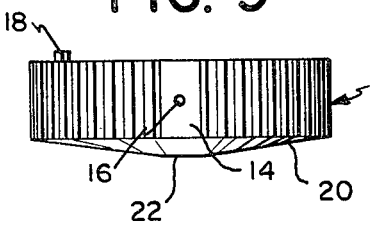
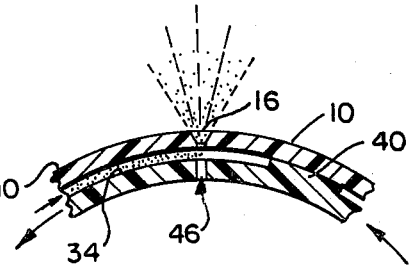
FIG. 10
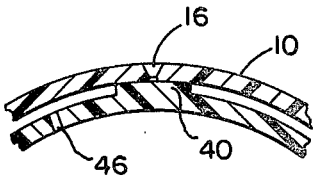
FIG. 11
FIG. 14
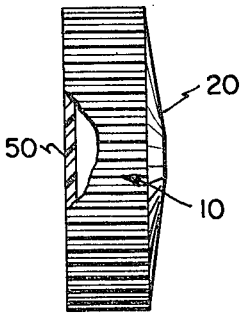
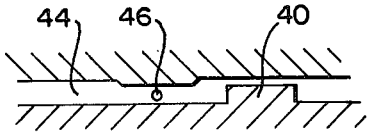
FIG. 12
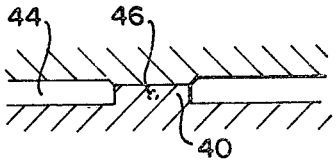
FIG. 13

DISPENSER USING BELLEVILLE DIAPHRAGM

PRIOR ART STATEMENT

Manually operable pumps are used to dispense a mixture of air and powder or liquid in the form of a spray from a container filled with the powder or liquid. Such pumps have relatively large number of parts and employ dip tubes extending into the container and its fill.

SUMMARY OF THE INVENTION

This invention is directed toward a new type of manually operable dispenser which uses only two parts which also form the container and which uses no dip tube whatsoever. This dispenser functions smoothly and efficiently and is much less expensive than prior art devices.

In accordance with the principles of the invention, each of first and second shallow hollow cylinders has a closed end and an open end, said cylinders being interconnected at their open ends with the first cylinder being disposed concentrically within the second cylinder. Each cylinder is rotatable through a selected arc with respect to the other cylinder between open and closed positions. The cylinders have cooperating means defining a channel in the outer surface of the first cylinder which forms a circular arc and which lies in a plane perpendicular to the axes of the cylinders, the first cylinder having first and second oppositely disposed openings extending through the cylinder wall and lying in the plane of the channel. The second cylinder has a third opening extending through the cylinder wall and lying in the plane of the channel. The third opening, when the cylinders are in the open position, is in registration both with the first opening and the channel and, when the cylinders are in the closed position, is out of registration with the first opening and the channel. The closed end of the second cylinder defines a belleville diaphragm. (A belleville diaphragm as will be explained in more detail hereinafter is a diaphram which can be manually pressed inwardly and which, after the pressure is released, will automatically return to the original position).

In use the interior of the first cylinder is partially filled with a powder or liquid (including a viscous liquid) which is to be dispensed as a spray. The cylinders are disposed with axes horizontal and with the second opening of the first cylinder disposed at the bottom, whereby the first opening of the first cylinder is disposed at the top. The cylinders are placed in the open position and the washer is pushed in. This action produces a pressure build up causing the air in the first cylinder (there is necessarily air therein since this cylinder is only partially filled) to pass through the first opening into the channel and at the same time causing the powder or liquid to pass through the second opening into the channel and to flow along the channel to mix with the air in the region of the first opening, this mixture being discharged as the desired spray out of the aligned third opening.

When the pressure on the washer is released, it snaps back automatically into its original position, producing a suction within the first cylinder which draws air inwardly through the first and third openings. The air flow is thus reversed and clears the openings of any residual powder or liquid whereby clogging cannot occur.

More efficient action can be produced when the closed end of the first cylinder also defines a belleville diaphragm. Then both cylinders can be depressed simultaneously thus producing a larger build up and released simultaneously, thus producing a larger suction.

BRIEF DESCRIPTION OF THE DRAWINGS

FIG. 2 shows one end view thereof.

FIG. 3 shows an opposite end view thereof.

FIG. 4 shows a side view of the dispenser of FIG. 1 as fully assembled.

FIG. 5 shows a vertical cross section of the assembled dispenser shown in open position.

FIG. 6 is a view taken along lines 6—6 in FIG. 5.

FIG. 7 is a top view of the assembled dispenser.

FIG. 8 is an exploded top view of the dispenser of FIG. 1. FIG. 9 is a top view of one of the two parts of FIG. 1. FIGS. 10 and 11 are detail side views of portions of the assembled dispenser of FIG. 1 shown in open and closed positions respectively.

FIGS. 12 and 13 are detail bottom views of some of the portions of the assembled dispenser of FIG. 1 shown in open and closed position respectively.

FIG. 14 is a view of a modification of the dispenser shown in FIGS. 1–13.

DESCRIPTION OF PREFERRED EMBODIMENTS

Figure 1:
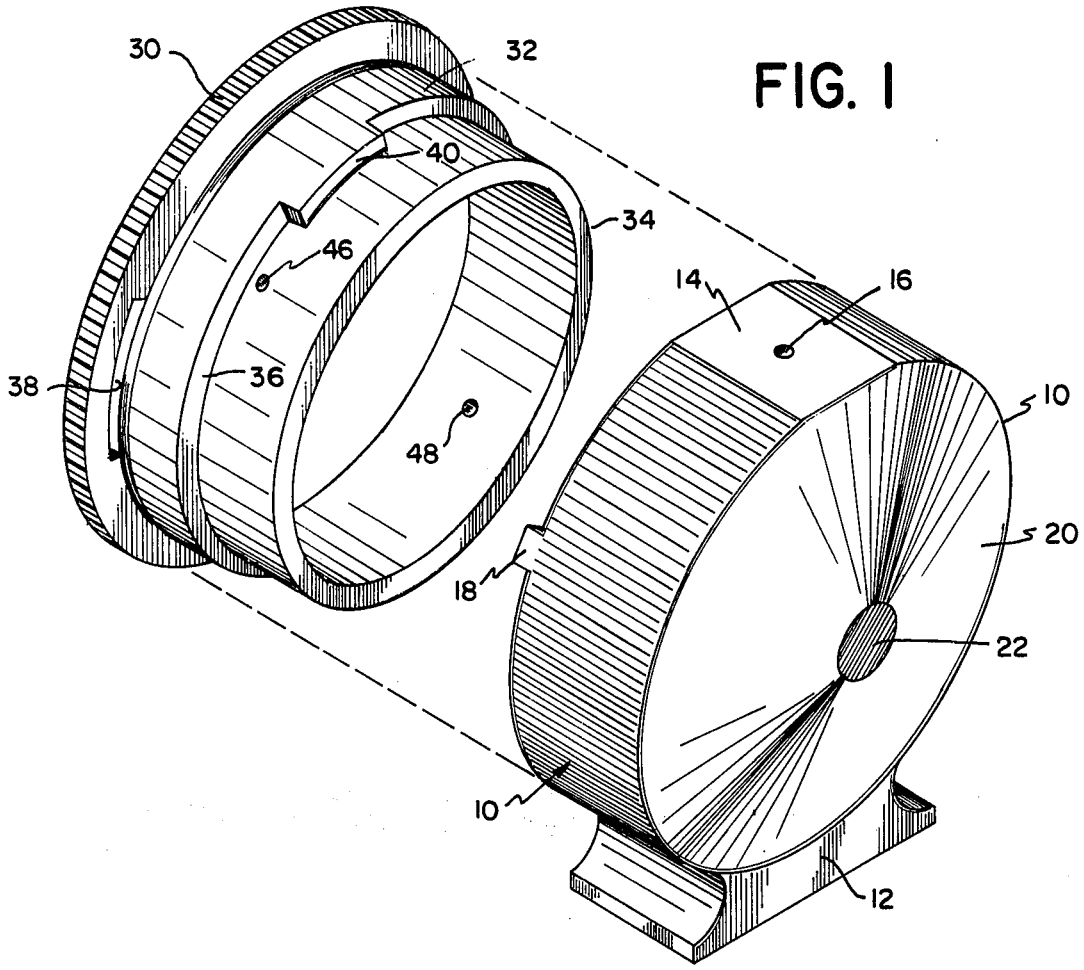
FIG. 1 is an exploded view of a dispenser in accordance with the invention.

Referring first to FIGS. 1–13, the dispenser shown is formed entirely of polypropylene or other suitable material. The dispenser is formed from two interconnected parts.

The first part is a hollow shallow cylinder having one closed end and one open end. This part has a cylindrical portion 10 with an outer knurled surface. The portion 10 is shown in position with a horizontal axis and has a bottom supporting base 12 and a top disposed small flat region 14 with a central hole 16 extending through the cylinder wall. The open end of portion 10 has an outwardly extending tab 18. The closed end 20 of portion 10 defines a molded belleville diaphragm which acts as a belleville spring. The typical uniform thickness of end 20 ranges between 0.015 and 0.030 inches. It has a small centrally disposed flat 22 for receiving a finger and defines a very shallow truncated quasi-cone in cross section with an included angle somewhat less than 180 degrees, in this example 165 degrees. When the end is manually depressed by placing a finger on flat 22 and pushing inward, and the finger is subsequently removed, the end will automatically return to its original position. It is this self restoring action which characterizes a belleville diaphragm or spring. It should be noted that if the included angle is set at too small an angle, as for example 160 degrees, this self restoring action will not occur and the resulting structure is not a belleville diaphragm. When this washer is an actual cone, a popping noise is produced when the washer returns to its original position. By producing a slight bulge in the washer as shown in the drawings, this noise is eliminated and the washer functions silently.

The inner surface of cylindrical portion 10 consists of two adjacent cylindrical surfaces 24 and 26 disposed about a common axis which is also the axis of portion 10 and differing in diameter, surface 26 having the larger diameter, these surfaces being separated by shoulder 28.

The second part is also a hollow shallow cylinder having one closed end and one open end. The closed end is another belleville diaphragm 20 with an outwardly extending peripheral lip 30 having a knurled outer surface. The cylindrical portion consists of two adjacent hollow cylinders 32 and 34 centered upon the above mentioned common and separated by shoulder 36. The cylinder 34 of smaller diameter fits slidably into surface 24 of portion 10. The cylinder 36 fits slidably within surface 26. Portion 10 bears against the lip 30 with tab 18 engaging an elongated curved slot 38 whereby the two parts can be rotated one within the other along a selected arc defined by the length of slot 38.

The combination of tab 40 and shoulder 28 defining channel 44 constitutes first cooperating means of the two cylinders.

The combination of tab 18 and slot 38 constitutes second cooperating means of the two cylinders.

The combination of holes 46, 48 and 16 together with the tab 18 and slot 38 constitutes third cooperating means of the two cylinders.

The outer edge of cylinder 32 has an outwardly extending tab 40 which bears against shoulder 28, thus defining a circular groove or channel 44 on the outer surface of cylinder 34. If this second part is considered as having one cylinder shaped to define cylinders 32 and 34, this groove is defined in the outer surface of this one cylinder. This groove lies in a plane perpendicular to the common axis.

Cylinder 34 has two holes 46 and 48 spaced 180 degrees apart which extend through the cylinder wall and are aligned with groove 44. When the two parts are rotated to one extreme position of tab 18 in slot 38, hole 46 is vertically aligned with hole 16, both holes 46 and 16 communicate with groove 44, and hole 48 communicates with the groove 44. This position is defined as the open position. When the two parts are rotated to the other extreme position of tab 18 in slot 38, hole 46 is moved out of vertical registration with 16 and hole 16 is sealed by tab 40. Hole 48 continues to communicate with groove 44. This position is defined as the closed position.

In use, the interior of the inner cylinder is partially filled in air with powder, liquid or viscous liquid to be dispensed. When the dispenser is disposed vertically, base down, and is then placed in closed position, no leakage can occur. When the dispenser is placed in the open position, and both washers are squeezed inward, the pressure build up forces air originally in the interior outward through opening 46 and the powder or liquid through opening 48 and along the channel. As the air passes through opening 46 and the powder or liquid passes along the channel, the air and powder or liquid meet, and mix. The mixture is forced through opening 16 and breakup occurs thereat with the desired spray being produced. Once the squeezing pressure is released, the washers snap back into original position and air is drawn inward to clear the openings as previously described.

The modification of FIG. 14 employs only one Belview washer rather than two. The closed end 50 which no longer functions as a washer is made sufficiently thick so as not to be squeezed inward when the dispenser is actuated. This embodiment functions in the same manner as described above but functions less efficiently.

Typically opening 16 ranges between 0.020 and 0.040 inches in diameter, opening 46 ranges between 0.013 and 0.035 inches in diameter and opening 48 ranges between 0.020 and 0.060 inches in diameter. The thickness of the various walls other than the Belview washer ranges between 0.040 and 0.050 inches. The channel typically has a width ranging between 0.020 and 0.060 inches and a depth ranging between 0.015 and 0.030 inches. The overall diameter of the dispenser typically ranges between 1.0 and 3.0 inches while its width ranges between 0.25 and 0.50 inches.

The dispenser is assembled by a snap fit wherein bead 52 engages undercut portion 54 and the two parts are engaged.

What is claimed is:

1. A manually operable dispenser comprising: first and second shallow hollow cylinders, each cylinder having a wall with an outer surface, a closed end and an open end, said cylinders being interconnected at their open ends with the first cylinder being disposed concentrically within the second cylinder, the cylinders having first cooperating means defining a channel on the outer surface of the first cylinder which forms a circular arc and which lies in a plane perpendicular to the axes of the cylinders, the first cylinder having first and second oppositely disposed openings extending through the cylinder wall and lying in the plane of the channel, the second cylinder having a third opening extending through the cylinder wall and lying in the plane of the channel, said cylinders being provided with second cooperating means which enables each cylinder to be rotatable through a selected arc with respect to the other cylinder between open and closed positions, said third opening, when the cylinders are in the open position being in registration both with the first opening and the channel and when the cylinders are in the closed position being out of registration with the first opening and the channel, the closed end of the second cylinder defining a belleville diaphragm.

2. The dispenser of claim 1 wherein both of said closed ends define belleville diaphragm.

3. The dispenser of claim 2 wherein the cylinders are provided with third cooperating means for placing the first and third openings in registration with each other and the channel when the cylinders are in open position and for placing the third opening out of registration with the first opening when the cylinders are in closed position, the second opening communicating with the channel when the cylinders are in either position.

4. The dispenser of claim wherein said second cooperating means limits the rotation of one cylinder relative to the other to said selected arc.

5. The dispenser of claim 4 wherein the closed end of the first cylinder has an outwardly disposed lip with a curved slot therein and said second cylinder has a tab riding in said slot, said slot and tab constituting said third cooperating means.

6. The dispenser of claim 5 wherein the closed position is attained when the tab engages one end of the slot and the open position is attained when the tab engages the other end of the slot.

7. The dispenser of claim 6 wherein the periphery of the lip and the outer periphery of the second cylinder are knurled.

8. The dispenser of claim 7 wherein (the region of) the second cylinder has a flat region about the third opening (is flat) and wherein (the region of) the second cylinder has a region disposed opposite to the third opening which is provided with a supporting base.

* * * * *